US005888058A

United States Patent [19]

Leroy et al.

[11] Patent Number: 5,888,058

[45] Date of Patent: Mar. 30, 1999

[54] POSITIVE DISPLACEMENT MACHINE HAVING ROTATING VANES AND A NON-CIRCULAR CHAMBER PROFILE

[76] Inventors: André Leroy, 64, Chaussée du Roi-Baudouin - Saint-Symphorien, 7030 Mons, Belgium; Jean-Marie Flamme, 23, Boulevard Richard-Lenoir - 75011, Paris, France

[21] Appl. No.: 875,874

[22] PCT Filed: Feb. 8, 1996

[86] PCT No.: PCT/FR96/00210

§ 371 Date: Aug. 6, 1997

§ 102(e) Date: Aug. 6, 1997

[87] PCT Pub. No.: WO96/24754

PCT Pub. Date: Aug. 15, 1996

[30] Foreign Application Priority Data

Feb. 10, 1995 [FR] France ..... 95/01557

[51] Int. Cl.[6] ..... F01C 1/344; F01C 21/10

[52] U.S. Cl. ..... 418/150

[58] Field of Search ..... 418/150, 259

[56] References Cited

U.S. PATENT DOCUMENTS

| | | | |
|---|---|---|---|
| 4,480,973 | 11/1984 | Ishizuka | 418/150 |
| 4,501,537 | 2/1985 | Ishizuka | 418/150 |
| 4,507,068 | 3/1985 | Hayase et al. | 418/150 |
| 4,712,987 | 12/1987 | Inomata | 418/150 |
| 4,802,830 | 2/1989 | Nakajima | 418/150 |

FOREIGN PATENT DOCUMENTS

| | | | |
|---|---|---|---|
| 32 31 588 | 7/1983 | Germany . | |
| 38 00 324 | 7/1988 | Germany . | |
| 57-108484 | 7/1982 | Japan | 418/150 |

*Primary Examiner*—John J. Vrablik
*Attorney, Agent, or Firm*—Young & Thompson

[57] ABSTRACT

A positive-displacement machine with movable sealing members (4) including at least one encased system which essentially comprises a casing consisting of a cylindrical tubular portion (1) with a non-circular directrix (10), and two sealing flanges; and a cylindrical piston (2) having a circular directrix (20) and being provided with grooves (3) for guiding the sealing members in the piston, said piston having a rotary connection to the casing. The directrix of the tubular portion of the casing consists of n arcs of conformity and n bows restricting the motion of the sealing members in the grooves. The bows are defined by solving a set of equations.

10 Claims, 3 Drawing Sheets

POSITIVE DISPLACEMENT MACHINE HAVING ROTATING VANES AND A NON-CIRCULAR CHAMBER PROFILE

The subject of the invention is a displacement machine with moving sealing elements, comprising at least one encapsulation essentially including a capsule consisting of a cylindrical tubular part with non-circular directrix and two end flanges, a cylindrical piston whose directrix is a circle of centre O and of radius $R_p$, provided with grooves which guide the sealing elements in the piston, this piston being in rotary connection with the capsule about its axis, as well as a system for distributing the fluid, allowing its inlet and its outlet. In this machine, the moving sealing elements are most often vanes, but may be rollers. The directrix of the tubular part of the capsule, called the capsule profile, is constituted successively and alternately by n circle arcs called conformity arcs, with optionally zero angular aperture, of centre O and of radius $R_p$+J, J denoting the radial play between these arcs and the directrix of the piston, as well as n geometrical arcs, called arches, which limit the movement of the sealing elements in the grooves in the centrifugal direction. Each arch has, with the adjacent conformity arcs, two connection points $M_i$ and $M_f$ at which the radii of curvature are respectively equal to $R_{ci}$ and to $R_{cf}$, and at which the angles $\tau_i$ and $\tau_f$, respectively, of the tangents differ by $\pi/2$ from the corresponding polar angles $\theta_i$ and $\theta_f$; each arch also contains a point $M_e$ at which the polar radius is a maximum, equal to Rp+J+H, at which the angle $\tau_e$ of the tangent differs by $\pi/2$ from the corresponding polar angle $\theta_e$ and at which the radius of curvature $R_{ce}$ is less than $R_p$.

Numerous displacement machines which correspond to this definition are known, and in particular the machines described successively in the following patents and patent applications: U.S. Pat. No. 2,791,185, JP 58-174102 and FR 2 547 622.

In each of these patents, an original capsule profile is claimed, in U.S. Pat. No. 2,791,185 in order to correspond to a particular organisation of the machine, in patent JP 58-174102 in order to accelerate the extension of the vanes and to slow their retraction, and in patent FR 2 547 622 in order to provide a better compromise between the various constraints imposed by the design of high-performance machines.

A tendency to progressive improvement of that geometrical element of the machine which is most critical for performance, and a virtually inevitable tendency to a substantial increase in the number of parameters required to specify a capsule profile, which makes it difficult to express the optimization constraints by using these parameters and, above all, to rank these constraints, can be observed through these three patents.

In the machines according to the invention, this tendency is departed from by providing a novel geometry of the capsule profile which directly satisfies the two major requirements to which high-performance machines are currently subject, namely compactness and smooth running, while needing to resort only to a minimal number of parameters in order to specify this geometry.

The invention assumes the following geometrical data to be a priori set: $R_p$, n, $H/R_p$, J, $\theta_i$, $\theta_e$, $\theta_f$, to which at most the radii of curvature $R_{ci}$, $R_{ce}$ and $R_{cf}$ may be added.

$R_p$ is the gauge radius of the machine and is set in conjunction with the desired value of the volume capacity for a unitary width of the encapsulation;

n is generally equal to 1, 2 or 3;

the ratio $H/R_p$ is set to be as large as possible in order to reduce the overall size of the machine; this ratio is, however, limited by the possibility of producing the grooves in the piston, the difficulty of which increases as the value n decreases, and by the necessity of obtaining a profile which has a sufficient radius of curvature at each of its points, in particular in order to ensure contact between the sealing element and the capsule with a Hertz pressure which is as low as possible, and which has a sufficient curvature to prevent retraction of the sealing elements in the piston under the combined action of the fluid pressure and the inertial reactions;

the play J is set by technological and economic considerations;

$\theta_i$ and $(2\pi/n-\theta_f)$ are set in order to ensure good sealing between the piston and the capsule, in particular in view of the level of the pressure difference between inlet and outlet, the desired ratio $H/R_p$, the set play J and the width of the vanes or the diameter of the rollers, depending on the case;

$\theta_e$ may be equal to $(\theta_i+\theta_f)/2$ or differ from this value, in particular in order to make the inertial reactions on the arc $M_iM_e$ and on the arc $M_eM_f$ asymmetric, thus making it possible, to some extent, to regularize the engine torque; in this regard, the point $M_e$ is most often brought closer to the point $M_i$ $(2\theta_e \leqq \theta_i+\theta_f)$ when the fluid is on average at lower pressure on the arc $M_iM_e$ than on the arc $M_eM_f$, and the point $M_e$ is most often brought closer to the point $M_f$ $(2\theta_e \geqq \theta_i+\theta_f)$ in the opposite case; it can be seen that the asymmetry of the arcs $M_iM_e$ and $M_eM_f$ should be reduced as values of n and $H/R_p$ increase;

when the radii of curvature $R_{ci}$, $R_{ce}$ and $R_{cf}$ are a priori set, their values should be as large as possible in order, for fixed $H/R_p$, to minimize the overall size of the machine, the value of $R_{ce}$ being, however, limited to a value less than $R_p$, those of $R_{ci}$ and $R_{cf}$ being limited by the risk of retraction of the sealing elements in the piston, under conditions at which the inlet and outlet pressures are identical or similar.

The machines according to the invention have a capsule profile of which an arc has as intrinsic equation, that is to say expressed independently of any reference frame:

$$\frac{ds}{d\tau} = R_{ce} + \sum_{\alpha=\alpha_1}^{\alpha_a} \delta \cdot A_\alpha \cdot (\tau_e - \tau)^\alpha + \sum_{\beta=\beta_1}^{\beta_b} (1-\delta) \cdot B_\beta \cdot (\tau - \tau_e)^\beta \quad \text{(I)}$$

equation (I) in which:

$\delta=1$ when $\tau \leqq \tau_e$ and $\delta=0$ when $\tau > \tau_e$, $2 \leqq a \leqq 4$, $2 \leqq b \leqq 4$, $-1 \leqq a-b \leqq 1$, $a+b \geqq 5$, ds represents the infinitely small increase in the curvilinear abscissa s at a running point M on the arch, calculated from an arbitrary origin, $\tau$ denotes the angle of the tangent to the arch at M, $d\tau$ represents the infinitely small increase in the angle $\tau$ at M, $\alpha_1, \ldots, \alpha_a$ denote a set of a shape parameters of the arch, $\beta_1, \ldots, \beta_b$ denote a set of b shape parameters of the arch, these shape parameters being sufficiently large for the evolute of the arch in the vicinity of the point $M_e$ to have, to within a precision $\epsilon$ of less than or equal to 1 $\mu$m, an angular point $D_e$, which is expressed by the following two conditions:

$$\sum_{\alpha=\alpha_1}^{\alpha_a} A_\alpha \cdot (\tau_e - \tau_m)^\alpha = \epsilon$$

$$\sum_{\beta=\beta_1}^{\beta_b} B_\beta \cdot (\tau_d - \tau_e)^\beta = \epsilon$$

in which $(\tau_e-\tau_m)$ represent the angle made by one of the tangents to the evolute of the arch at the angular point $D_e$ with the radial direction specified by $\theta_e$, and $(\tau_d-\tau_e)$ represents the angle of the other tangent at the angular point $D_e$ with this same radial direction, the $A_\alpha$ denote a set of a geometrical parameters, the $B_\beta$ denote a set of b geometrical parameters, the a+b geometrical parameters $A\alpha_1, \ldots, A\alpha_a, B\beta_1, \ldots, B\beta_b$ and, optionally, the radius of curvature $R_{ce}$ being solutions of the system consisting of the following six equations (II) to (VII), optionally supplemented by the equation (VIII) if the radius of curvature $R_{ci}$ is set and by equation (IX) if the radius of curvature $R_{cf}$ is set:

$$\sum_{\alpha=\alpha_1}^{\alpha_a} \alpha \cdot A_\alpha \cdot (\tau_e - \tau_i)^{\alpha-1} = 0 \quad \text{(II)}$$

$$\sum_{\beta=\beta_1}^{\beta_b} \beta \cdot B_\beta \cdot (\tau_f - \tau_e)^{\beta-1} = 0 \quad \text{(III)}$$

$$\int_{\tau_i}^{\tau_e} \cos\tau \cdot \frac{ds}{d\tau} \cdot d\tau = (R_p + J + H) \cdot \sin\tau_e - (R_p + J) \cdot \sin\tau_i \quad \text{(IV)}$$

$$\int_{\tau_i}^{\tau_e} \sin\tau \cdot \frac{ds}{d\tau} \cdot d\tau = (R_p + J) \cdot \cos\tau_i - (R_p + J + H) \cdot \cos\tau_e \quad \text{(V)}$$

$$\int_{\tau_e}^{\tau_f} \cos\tau \cdot \frac{ds}{d\tau} \cdot d\tau = (R_p + J) \cdot \sin\tau_f - (R_p + J + H) \cdot \sin\tau_e \quad \text{(VI)}$$

$$\int_{\tau_e}^{\tau_f} \sin\tau \cdot \frac{ds}{d\tau} \cdot d\tau = (R_p + J + H) \cdot \cos\tau_e - (R_p + J) \cdot \cos\tau_f \quad \text{(VII)}$$

$$\sum_{\alpha=\alpha_1}^{\alpha_a} A_\alpha \cdot (\tau_e - \tau_i)^\alpha + (R_{ce} - R_{ci}) = 0 \quad \text{(VIII)}$$

$$\sum_{\beta=\beta_1}^{\beta_b} B_\beta \cdot (\tau_f - \tau_e)^\beta + (R_{ce} - R_{cf}) = 0 \quad \text{(IX)}$$

When all the geometrical data ($R_p$, n, $H/R_p$, J, $\theta_i$, $\theta_e$, $\theta_f$, $R_{ci}$, $R_{ce}$ and $R_{cf}$) are a priori set, which presupposes that they have been reasonably set, that is to say while respecting the considerations specified above, a should be equal to four, b should also be equal to four and the designer should select the eight shape parameters $\alpha_1, \ldots, \alpha_4, \beta_1, \ldots, \beta_4$ in equation (I). When making this choice, the designer enters into a compromise between the requirement of having as smooth as possible a variation in the curvature on the arcs $M_iM_e$ and $M_eM_f$ respectively, and the desire for a radius of curvature which is as large as possible and varies as little as possible in the vicinity of the point $M_e$, over the largest possible angular aperture.

If one or more of the radii of curvature $R_{ci}$, $R_{ce}$ or $R_{cf}$ are not to be a priori set, the invention can be applied according to one of the seven following variants, which all have the benefit of a reduction in the number of parameters to be selected. It should emphatically be pointed out that, in these variants, the calculated value of any radius of curvature not set at one of the points $M_i$, $M_e$ or $M_f$ is automatically the one which gives the least possible average curvature over the arcs $M_iM_e$ or $M_eM_f$, depending on the case, taking into account the other a priori set constraints.

According to a first variant, $R_{ce}$ and $R_{ci}$ are a priori set, a=4, b=3, the seven geometrical parameters $A\alpha_1, \ldots, A\alpha_4, B\beta_1, \ldots, B\beta_3$ are solutions of the system consisting of the seven equations (II) to (VIII); $R_{cf}$ is then calculated from equation (I) in which $\tau$ has been replaced by $\tau_f$.

According to a second variant, $R_{ce}$ and $R_{cf}$ are a priori set, a=3, b=4; the seven geometrical parameters $A\alpha_1, \ldots, A\alpha_3, B\beta_1, \ldots, B\beta_4$ are solutions of the system consisting of the seven equations (II) to (VII) and (IX); $R_{ci}$ is then calculated from equation (I) in which $\tau$ has been replaced by $\tau_i$.

According to a third variant, only $R_{ce}$ is a priori set, a=3, b=3; the six geometrical parameters $A\alpha_1, \ldots, A\alpha_3, B\beta_1, \ldots, B\beta_3$ are solutions of the system consisting of the six equations (II) to (VII); $R_{ci}$ and $R_{cf}$ are then calculated from equation (I) in which $\tau$ has been replaced by $\tau_i$ and by $\tau_f$, respectively.

According to a fourth variant, $R_{ci}$ to $R_{cf}$ are a priori set, $a \geqq 3$, $b \geqq 3$, a+b=7; the radius of curvature $R_{ce}$ and the seven geometrical parameters $A\alpha_1, \ldots, A\alpha_a, B\beta_1, \ldots, B\beta_b$ are solutions of the system consisting of the eight equations (II) to (IX).

According to this variant of the invention, two particular cases are distinguished between, corresponding respectively to a=3 and b=4, on the one hand, or to a=4 and b=3, on the other hand. The first possibility is preferably utilized when $2\tau_e \leqq \tau_i+\tau_f$, and the second when $2\tau_e \geqq \tau_i+\tau_f$. It can be seen that when $2\tau_e=\tau_i+\tau_f$ and when $\alpha_1=\beta_1$, $\alpha_2=\beta_2$, $\alpha_3=\beta_3$, the geometrical parameter $B_{\beta 4}$ or $A_{\alpha 4}$, depending on the case, becomes identically equal to zero, regardless of the value selected for the shape parameter $\beta_4$ or $\alpha_4$.

According to a fifth variant, only $R_{ci}$ is a priori set, $a \geqq 3$, $b \geqq 2$, a+b=6; the radius of curvature $R_{ce}$ and the six geometrical parameters $A\alpha_1, \ldots, A\alpha_a, B\beta_1, \ldots, B\beta_b$ are solutions of the system consisting of the seven equations (II) to (VIII); $R_{cf}$ is then calculated from equation (I) in which $\tau$ has been replaced by $\tau_f$. According to this variant of the invention, two particular cases are distinguished between, corresponding respectively to a=3 and b=3, on the one hand, or to a=4 and b=2, on the other hand. The first possibility is preferably utilized when $2\tau_e \leqq \tau_i+\tau_f$, and the second when $2\tau_e \geqq \tau_i+\tau_f$.

According to a sixth variant, only $R_{cf}$ is a priori set, $a \geqq 2$, $b \geqq 3$, a+b=6; the radius of curvature $R_{ce}$ and the six geometrical parameters $A\alpha_1, \ldots, A\alpha_a, B\beta_1, \ldots, B\beta_b$ are solutions of the system consisting of the seven equations (II) to (VII) and (IX); $R_{ci}$ is then calculated from equation (I) in which $\tau$ has been replaced by $\tau_i$. According to this variant of the invention, two particular cases are distinguished between, corresponding respectively to a=2 and b=4, on the one hand, or to a=3 and b=3, on the other hand. The first possibility is preferably utilized when $2\tau_e \leqq \tau_i+\tau_f$, and the second when $2\tau_e \geqq \tau_i+\tau_f$.

According to a seventh variant, $a \geqq 2$, $b \geqq 2$, a+b=5; the radius of curvature $R_{ce}$ and the five geometrical parameters $A\alpha_1, \ldots, A\alpha_a, B\beta_1, \ldots, B\beta_b$ are solutions of the system consisting of the six equations (II) to (VII); $R_{ci}$ and $R_{cf}$ are then calculated from equation (I) in which $\tau$ has been replaced by $\tau_i$ and by $\tau_f$, respectively.

According to this variant of the invention, two particular cases are distinguished between, corresponding respectively to a=2 and b=3, on the one hand, or to a=3 and b=2, on the other hand. The first possibility is preferably utilized when $2\tau_e \leqq \tau_i+\tau_f$, and the second when $2\tau_e \geqq \tau_i+\tau_f$. It can be seen that when $2\tau_e=\tau_i+\tau_f$ and when $\alpha_1=\beta_1$, $\alpha_2=\beta_2$, the geometrical parameter $B_{\beta 3}$ or $A_{\alpha 3}$, depending on the case, becomes identically equal to zero, regardless of the value selected for the shape parameter $\beta_3$ or $\alpha_3$.

The following table specifies, for the various possible combinations of the values of the parameters a and b, whether the radii of curvature $R_{ci}$, $R_{ce}$ and $R_{cf}$ are to be a priori set, whether they are calculated from equation (I) or whether they are solutions, with the geometrical parameters $A\alpha_1, \ldots, A\alpha_a, B\beta_1, \ldots, B\beta_b$, of the system of equations (II) to (VII), optionally supplemented by equations (VIII) and (IX). The last column in this table indicates the numbers of the equations in this system.

| a | b | $R_{ci}$ | $R_{ce}$ | $R_{cf}$ | No. of the equations |
|---|---|---|---|---|---|
| 4 | 4 | selected | selected | selected | (II) to (IX) |
| 4 | 3 | selected | selected | calculated | (II) to (VIII) |
| 3 | 4 | calculated | selected | selected | (II) to (VII), (IX) |
| 3 | 3 | calculated | selected | calculated | (II) to (VII) |
| 4 | 3 | selected | solution | selected | (II) to (IX) |
| 3 | 4 | selected | solution | selected | (II) to (IX) |
| 3 | 3 | selected | solution | calculated | (II) to (VIII) |
| 4 | 2 | selected | solution | calculated | (II) to (VIII) |
| 3 | 3 | calculated | solution | selected | (II) to (VII), (IX) |
| 2 | 4 | calculated | solution | selected | (II) to (VII), (IX) |
| 3 | 2 | calculated | solution | calculated | (II) to (VII) |
| 2 | 3 | calculated | solution | calculated | (II) to (VII) |

The advantages of the displacement machines according to the invention and, quite particularly, of those in which the number of shape parameters is limited to five, are as follows:

for H and $\theta_e$ selected reasonably, a smaller variation in curvature along each arch than in any known solution, which leads to regularization of the inertial effects on the moving sealing elements and thus to a substantial reduction in their maximum value, possible access to hitherto inaccessible values of the ratio $H/R_p$, which makes machines with vanes according to the invention more compact than known machines, as a consequence of the two preceding advantages, access to on-board machines with vanes whose performance is superior to that of known machines.

In particular, for machines with vanes characterized by a value of n equal to 2, which correspond to the practical cases of greatest interest, and for a definition of the capsule profile which employs five shape parameters, the highest practically envisageable ratio $H/R_p:(H/R_p)_{limit}$, can be evaluated as follows as a function of the angle $\Delta\theta$ defined as the greater of the two angular apertures $(\theta_e-\theta_i)$ and $(\theta_f-\theta_e)$:

$$(H/R_p)_{limit} \cong 0.16\cdot(\Delta\theta)^2$$

Figure 1:
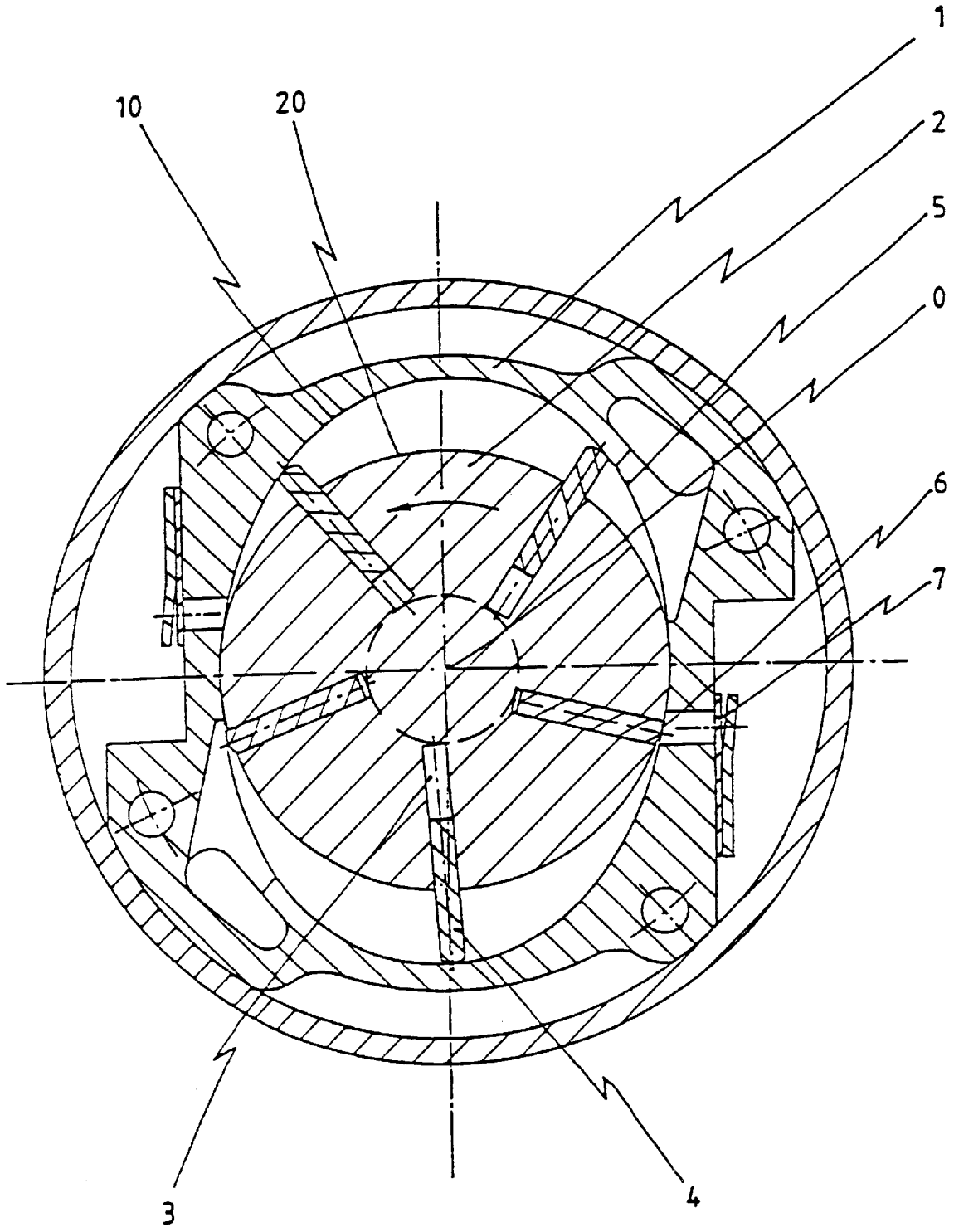
FIG. 1 illustrates, by way of example, a displacement compressor with vanes according to the invention.

FIG. 1 shows a cross-section in the compressor adopted by way of example. This figure shows the tubular part (1) of the fixed capsule, the piston (2), the circular directrix (20) of its outer surface and the five grooves, such as (3), which each guide a vane such as (4), the piercing point O of the axis common to the capsule, to the piston and to their rotary connection, the two inlet ports such as (5), the two outlet ports such as (6) and their valves such as (7). The tubular part of the capsule (1) is internally bounded via a cylindrical surface whose non-circular directrix (10) is the capsule profile. The sense of rotation of the piston about its axis is indicated by the arrow.

Figure 2:
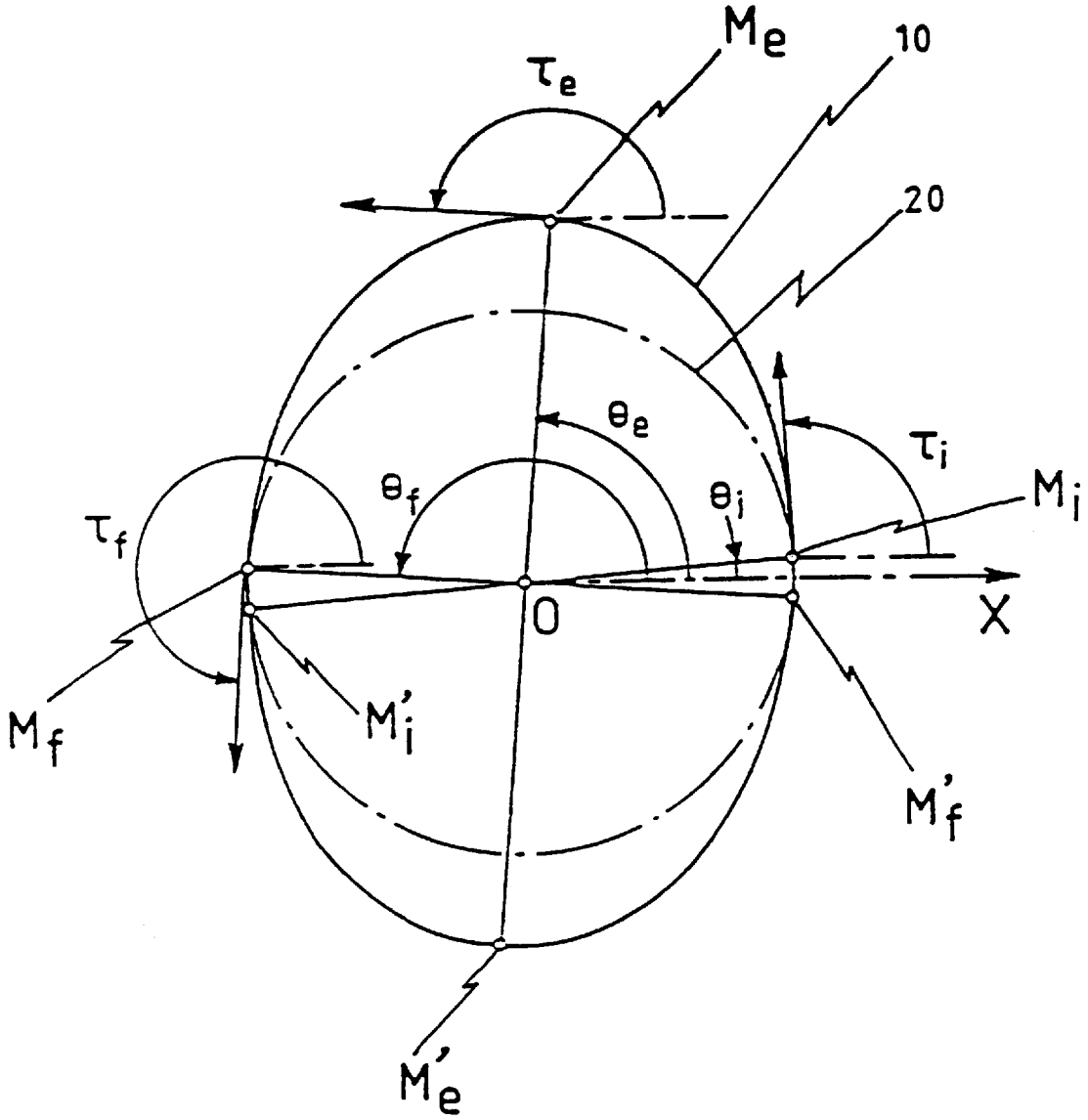
FIGS. 2, 3 and 4 represent, completely or partially, the shape of the capsule profile corresponding to the compressor illustrated in FIG. 1.

FIG. 2 shows the capsule profile (10) consisting of n=2 identical arches and n=2 conformity arcs, belonging to the same circle with centre O and with radius $(R_p+J)$, as well as the circular directrix (20) of the outer surface of the piston, the centre of which is also the point O and the radius of which is equal to $R_p$.

A first arch of the capsule profile is bounded by the points $M_i$ and $M_f$; the polar radius increases monotonically on this arch from the point $M_i$ to the point $M_e$ and decreases monotonically from the point $M_e$ to the point $M_f$. The distance between the point O and the point $M_e$ is equal to $(R_p+J+H)$. Relative to the axis OX, the points $M_i$, $M_e$ and $M_f$ are located on the arch by the respective angles $\theta_i$, $\theta_e$ and $\theta_f$. This figure also shows the three angles $\tau_i$, $\tau_e$ and $\tau_f$ of the tangents to the arch at the respective points $M_i$, $M_e$ and $M_f$ measured relative to the direction of the axis OX.

A first conformity arc has the point $M_f$ as its origin and the point $M'_i$ as its end.

The second arch extends from the point $M'_i$ to the point $M'_f$ and contains the point $M'_e$ which is symmetrical to the point $M_e$ relative to the point O.

The second conformity arc has the point $M'_f$ as its origin and the point $M_i$ as its end.

The capsule profile is to be defined for the following geometrical data:

$R_p+J=30$ mm $H=9.25$ mm $\theta_i=4°$ $\theta_e=85°$ $\theta_f=176°$

This profile should consequently be defined by five shape parameters and, since $2\theta_e \leqq \theta_i+\theta_f$, the condition that a is equal to 2 and that b is equal to 3 is imposed. After numerical experimentation, the following values of the shape parameters were selected:

$\alpha_1=10$ $\alpha_2=15$ $\beta_1=10$ $\beta_2=15$ $\beta_3=6$

Solving the system of the six equations (II) to (VII) gives the following results:

$R_{ce}=25.989594$ mm $A_1=6.007911$ mm $A_2=-0.709261$ mm $B_1=-2.882993$ mm $B_2=0.113064$ mm $B_3=12.397607$ mm.

The following are calculated therefrom, to within one degree:

$$\tau_e-\tau_m=24° \text{ and } \tau_d-\tau_e=12°$$

The radius of curvature $R_{ci}$ at the point $M_i$ is equal to 89.847 mm. The radius of curvature $R_{cf}$ at the point $M_f$ is equal to 47.234 mm.

Between the polar angles equal to 47° and 118°, the radius of curvature lies between 30 mm and 25.990 mm.

Figure 3:
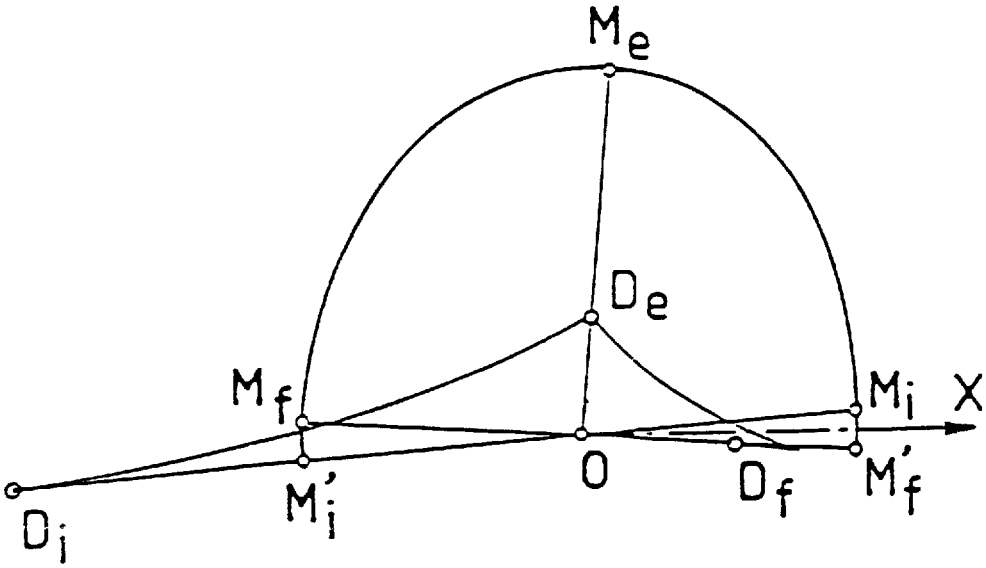

FIG. 3 represents an arch, the two conformity arcs of the capsule profile shown in FIG. 2 and the evolute of this arch, on which can be seen the angular point $D_e$ as well as the points $D_i$ and $D_f$, which are the respective centres of curvature of the arch at the points $M_e$, $M_i$ and $M_f$.

Figure 4:
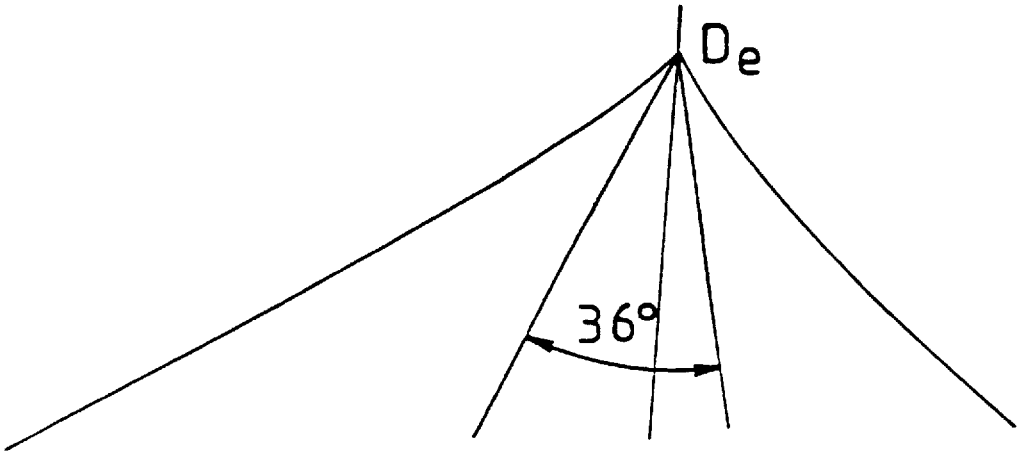

FIG. 4 represents, on an enlarged scale, a part of the evolute shown in FIG. 3 as well as its two tangents at the angular point $D_e$, which define an angle of 36°, equal to the angle $\tau_d-\tau_m$.

As regards the inertial forces at the centre of gravity of a vane of the compressor represented in FIG. 1, the ratio of these forces to those which the vane would be subjected to if the capsule profile were replaced at each of its points by the circle with the same polar radius, is equal to 1.18.

Finally, the volume capacity of the compressor, a cross-section of which is represented in FIG. 1, calculated on the basis of the chamber with maximum accessible volume, for vanes with a thickness equal to 4 mm and a capsule width of 54 mm, is 172 $cm^3$.

We claim:

1. Displacement machine with moving sealing elements (4), comprising at least one encapsulation essentially including a capsule consisting of a cylindrical tubular part (1) with non-circular directrix (10) and two end flanges, a cylindrical piston (2) whose directrix (20) is a circle of centre O and of radius $R_p$, provided with grooves (3) which guide the sealing elements (4) in the piston (2), this piston being in rotary connection with the capsule about its axis (0), as well as a system for distributing the fluid, allowing its inlet and its outlet, the directrix of the tubular part of the capsule (10), called the capsule profile, being constituted successively and alternately by n circle arcs called conformity arcs, with optionally zero angular aperture, of centre O and of radius $R_p$+J, J denoting the radial play between these arcs and the directrix of the piston, as well as n geometrical arcs, called arches, which limit the movement of the sealing elements in the grooves in the centrifugal direction, each arch having, with the adjacent conformity arcs, two connection points $M_i$ and $M_f$ at which the radii of curvature are respectively equal to $R_{ci}$ and to $R_{cf}$, at which the angles $\tau_i$ and $\tau_f$, respectively, of the tangents differ by $\pi/2$ from the corresponding polar angles $\theta_i$ and $\theta_f$, each arch also containing a point $M_e$ at which the polar radius is a maximum, equal to Rp+J+H, at which the angle $\tau_e$ of the tangent differs by $\pi/2$ from the corresponding polar angle $\theta_e$ and at which the radius of curvature $R_{ce}$ is less than $R_p$, characterized in that an arch has as intrinsic equation:

$$\frac{ds}{d\tau} = R_{ce} + \sum_{\alpha=\alpha_1}^{\alpha_a} \delta \cdot A_\alpha \cdot (\tau_e - \tau)^\alpha + \sum_{\beta=\beta_1}^{\beta_b} (1-\delta) \cdot B_\beta \cdot (\tau - \tau_e)^\beta \quad \text{(I)}$$

equation (I) in which:

$\delta=1$ when $\tau \leqq \tau_e$ and $\delta=0$ when $\tau>\tau_e$, $2 \leqq a \leqq 4$, $2 \leqq b \leqq 4$, $-1 \leqq a-b \leqq 1$, $a+b \geqq 5$, ds represents the infinitely small increase in the curvilinear abscissa s at a running point M on the arch, calculated from an arbitrary origin, $\tau$ denotes the angle of the tangent to the arch at M, $d\tau$ represents the infinitely small increase in the angle $\tau$ at M, $\alpha_1, \ldots, \alpha_a$ denote a set of a shape parameters of the arch, $\beta_1, \ldots, \beta_b$ denote a set of b shape parameters of the arch, these shape parameters being sufficiently large for the evolute of the arch in the vicinity of the point $M_e$ to have, to within a precision of less than or equal to 1 $\mu$m, an angular point $D_e$, the $A_\alpha$ denote a set of a geometrical parameters, the $B_\beta$ denote a set of b geometrical parameters, the a+b geometrical parameters $A\alpha_1, \ldots, A\alpha_a, B\beta_1, \ldots, B\beta_b$ and, optionally, the radius of curvature $R_{ce}$ being solutions of the system consisting of the following six equations (II) to (VII), optionally supplemented by the equation (VIII) if the radius of curvature $R_{ci}$ is set and by equation (IX) if the radius of curvature $R_{cf}$ is set:

$$\sum_{\alpha=\alpha_1}^{\alpha_a} \alpha \cdot A_\alpha \cdot (\tau_e - \tau_i)^{\alpha-1} = 0 \quad \text{(II)}$$

$$\sum_{\beta=\beta_1}^{\beta_b} \beta \cdot B_\beta \cdot (\tau_f - \tau_e)^{\beta-1} = 0 \quad \text{(III)}$$

$$\int_{\tau_i}^{\tau_e} \cos\tau \cdot \frac{ds}{d\tau} \cdot d\tau = (R_p + J + H) \cdot \sin\tau_e - (R_p + J) \cdot \sin\tau_i \quad \text{(IV)}$$

$$\int_{\tau_i}^{\tau_e} \sin\tau \cdot \frac{ds}{d\tau} \cdot d\tau = (R_p + J) \cdot \cos\tau_i - (R_p + J + H) \cdot \cos\tau_e \quad \text{(V)}$$

$$\int_{\tau_e}^{\tau_f} \cos\tau \cdot \frac{ds}{d\tau} \cdot d\tau = (R_p + J) \cdot \sin\tau_f - (R_p + J + H) \cdot \sin\tau_e \quad \text{(VI)}$$

$$\int_{\tau_e}^{\tau_f} \sin\tau \cdot \frac{ds}{d\tau} \cdot d\tau = (R_p + J + H) \cdot \cos\tau_e - (R_p + J) \cdot \cos\tau_f \quad \text{(VII)}$$

$$\sum_{\alpha=\alpha_1}^{\alpha_a} A_\alpha \cdot (\tau_e - \tau_i)^\alpha + (R_{ce} - R_{ci}) = 0 \quad \text{(VIII)}$$

$$\sum_{\beta=\beta_1}^{\beta_b} B_\beta \cdot (\tau_f - \tau_e)^\beta + (R_{ce} - R_{cf}) = 0. \quad \text{(IX)}$$

2. Machine according to claim 1, characterized in that the radii of curvature $R_{ce}$, $R_{ci}$ and $R_{cf}$ are a priori set, a=4, b=4, the eight geometrical parameters $A\alpha_1, \ldots, A\alpha_4, B\beta_1, \ldots, B\beta_4$ are solutions of the system consisting of the eight equations (II) to (IX).

3. Machine according to claim 1, characterized in that the radii of curvature $R_{ce}$ and $R_{ci}$ are a priori set, a=4, b=3, the seven geometrical parameters $A\alpha_1, \ldots, A\alpha_4, B\beta_1, \ldots, B\beta_3$ are solutions of the system consisting of the seven equations (II) to (VIII).

4. Machine according to claim 1, characterized in that the radii of curvature $R_{ce}$ and $R_{cf}$ are a priori set, a=3, b=4, the seven geometrical parameters $A\alpha_1, \ldots, A\alpha_3, B\beta_1, \ldots, B\beta_4$ are solutions of the system consisting of the seven equations (II) to (VII) and (IX).

5. Machine according to claim 1, characterized in that the radius of curvature $R_{ce}$ is a priori set, a=3, b=3, the six geometrical parameters $A\alpha_1, \ldots, A\alpha_a, B\beta_1, \ldots, B\beta b$ are solutions of the system consisting of the six equations (II) to (VII).

6. Machine according to claim 1, characterized in that the radii of curvature $R_{ci}$ to $R_{cf}$ are a priori set, $a \geqq 3$, $b \geqq 3$, a+b=7, the radius of curvature $R_{ce}$ and the seven geometrical parameters $A\alpha_1, \ldots, A\alpha_a, B\beta_1, \ldots, B\beta_b$ are solutions of the system consisting of the eight equations (II) to (IX).

7. Machine according to claim 1, characterized in that the radius of curvature $R_{ci}$ is a priori set, $a \geqq 3$, $b \geqq 2$, a+b=6, the radius of curvature $R_{ce}$ and the six geometrical parameters $A\alpha_1, \ldots, A\alpha_a, B\beta_1, \ldots, B\beta_b$ are solutions of the system consisting of the seven equations (II) to (VIII).

8. Machine according to claim 1, characterized in that the radius of curvature $R_{cf}$ is a priori set, $a \geqq 2$, $b \geqq 3$, $a+b=6$, the radius of curvature $R_{ce}$ and the six geometrical parameters $A\alpha_1, \ldots, A\alpha_a, B\beta_1, \ldots, B\beta_b$ are solutions of the system consisting of the seven equations (II) to (VII) and (IX).

9. Machine according to claim 1, characterized in that $a \geqq 2$, $b \geqq 2$, $a+b=5$, the radius of curvature $R_{ce}$ and the five geometrical parameters $A\alpha_1, \ldots, A\alpha_a, B\beta_1, \ldots, B\beta_b$ are solutions of the system consisting of the six equations (II) to (VII).

10. Machine with vanes according to claim 9, for which $n=2$, characterized in that the ratio $H/R_p$ is close to the limit ratio $(H/R_p)_{limit}$ specified by the expression:

$$(H/R_p)_{limit} \cong 0.16 \cdot (\Delta\theta)^2$$

in which $\Delta\theta$ represents the greater of the two angular apertures $(\theta_e - \theta_i)$ and $(\theta_f - \theta_e)$.

* * * * *